US010315736B2

(12) United States Patent
Monk

(10) Patent No.: US 10,315,736 B2
(45) Date of Patent: Jun. 11, 2019

(54) SUSPENSION SYSTEMS FOR MULTI-HULLED WATER CRAFT

(71) Applicant: NAUTI-CRAFT PTY LTD, Dunsborough, Western Australia (AU)

(72) Inventor: Richard Monk, Yalyalup (AU)

(73) Assignee: Nauti-Craft Pty Ltd, Dunsborough, Western Australia (AU)

( * ) Notice: Subject to any disclaimer, the term of this patent is extended or adjusted under 35 U.S.C. 154(b) by 196 days.

(21) Appl. No.: 15/527,825

(22) PCT Filed: Nov. 27, 2015

(86) PCT No.: PCT/AU2015/000727
§ 371 (c)(1),
(2) Date: May 18, 2017

(87) PCT Pub. No.: WO2016/081990
PCT Pub. Date: Jun. 2, 2016

(65) Prior Publication Data

US 2017/0313393 A1 Nov. 2, 2017

(30) Foreign Application Priority Data

Nov. 27, 2014 (AU) ..... 2014904806

(51) Int. Cl.
*B63B 39/00* (2006.01)
*B63B 1/14* (2006.01)

(52) U.S. Cl.
CPC ..... *B63B 39/00* (2013.01); *B63B 1/14* (2013.01); *B63B 2001/145* (2013.01)

(58) Field of Classification Search
CPC ..... B63B 39/00; B63B 1/14; B63B 2001/145
See application file for complete search history.

(56) References Cited

U.S. PATENT DOCUMENTS 5,592,894 A * 1/1997 Johnson ..... B60F 3/0038 114/274
7,314,014 B2 * 1/2008 Heyring ..... B63B 1/14 114/284

(Continued)

FOREIGN PATENT DOCUMENTS

WO 2014153600 A1 10/2014

OTHER PUBLICATIONS

International Search Report and Written Opinion for International Application No. PCT/AU2015/000727, dated Feb. 18, 2016, 9 pages.

*Primary Examiner* — Lars A Olson
*Assistant Examiner* — Jovon E Hayes
(74) *Attorney, Agent, or Firm* — Michael Best & Friedrich LLP

(57) ABSTRACT

A suspension system for a multi-hulled vessel including: a chassis and at least one left hull and at least one right hull; a front left, a back left, a front right and a back right support arrangements with respective rams; a first adjustment accumulator having a fluid chamber and a gas chamber; and a first actuator to transfer or effectively transfer fluid between the fluid chamber of the first adjustment accumulator and at least one compression chamber of a respective ram of a first support arrangement comprising one or more of the front left, front right, back left or back right support arrangements. A static pressure in the gas chamber of the first adjustment accumulator being within 25% of a static operating pressure in the at least one compression chamber of the at least one ram of the first support arrangement.

36 Claims, 8 Drawing Sheets

(56) References Cited

U.S. PATENT DOCUMENTS

| | | | | |
|---|---|---|---|---|
| 9,061,735 | B2 * | 6/2015 | Heyring | B63B 1/14 |
| 9,150,282 | B2 * | 10/2015 | Heyring | B63B 39/00 |
| 2012/0098172 | A1 * | 4/2012 | Trinh | B60G 17/0155 267/64.28 |
| 2015/0224845 | A1 * | 8/2015 | Anderson | B60G 17/019 701/37 |
| 2017/0313393 | A1 * | 11/2017 | Monk | B63B 1/14 |

* cited by examiner

SUSPENSION SYSTEMS FOR MULTI-HULLED WATER CRAFT

TECHNICAL FIELD

The present invention relates to suspension systems for multi-hulled water craft.

BACKGROUND

The applicant has developed a number of suspension systems for multi-hulled water craft where the hulls are able to move relative to a chassis or body portion, examples of which are disclosed in U.S. Pat. No. 7,314,014, and international publication numbers WO 2011/143692 and WO 2011/143694, details of which are incorporated herein by reference.

While underway, in many situations there is little benefit to providing active heave motion compensation, i.e. precisely controlling the overall height of chassis or body portion. However while docked or otherwise engaging with another object, be it a fixed dock or floating pontoon or other vessel, it can be beneficial to provide active heave motion compensation or at least active compensation of the vertical height of a point or region on the vessel, such as the bow.

It is known to provide active adjustment of a platform to compensate for vertical motions in addition to roll and pitch motions as disclosed in U.S. Pat. No. 5,822,813. Servos are used to provide the force required to position and support the platform, the support being non-resilient. Therefore the support force must be exceeded to generate an extension of the servo, and so the higher the load being supported, the more energy is required to effect a given displacement adjustment.

In U.S. Pat. No. 9,073,605 the support of a platform above two hulls is resilient, with electromagnetic actuators being positioned in parallel with separate pneumatic support springs. The electro-magnetic actuators are used to provide a force to displace the platform in roll, pitch and heave, but a requirement for a continual force due to a manoeuvre, such as centrifugal force during turns or pitch forces due to longitudinal acceleration or deceleration requires continual supply of energy to the actuators to provide the continual force in parallel with the springs.

It is to be understood that the prior art publications discussed above does not constitute an admission that the publication forms a part of the common general knowledge in the art, in Australia or any other country.

SUMMARY OF INVENTION

According to a first aspect of the invention there is provided a suspension system for a multi-hulled vessel, the vessel including a chassis and at least one left hull and at least one right hull, the suspension system supporting at least a portion of the chassis relative to the at least one left hull and at least one right hull, the suspension system including a front left support arrangement and a back left support arrangement between the at least one left hull and the chassis and including a front right support arrangement and a back right support arrangement between the at least one right hull and the chassis, each front left, front right, back left, back right support arrangement including at least one respective ram, and the suspension system including a first adjustment accumulator having a fluid chamber and a gas chamber; and a first actuator to transfer or effectively transfer fluid (for example, directly or indirectly) between the fluid chamber of the first adjustment accumulator and at least one compression chamber of a respective at least one ram of a first support arrangement comprising one or more of the front left, front right, back left or back right support arrangements, a static pressure in the gas chamber of the first adjustment accumulator being within 25% of a static operating pressure in the at least one compression chamber of the at least one ram of the first support arrangement.

Alternatively, the static pressure in the gas chamber of the first adjustment accumulator may be within 20%, or preferably within 15% or more preferably within 10% or more preferably within 5% of the static operating pressure in the at least one compression chamber of the at least one ram of the first support arrangement.

Alternatively, the static pressure in the gas chamber of the first supply accumulator may be substantially equal to the static operating pressure in the at least one compression chamber of the at least one ram of the first support arrangement.

The first actuator may be controllable to adjust an average stroke position of the at least one ram of the first support arrangement and/or to adjust an average pressure in the at least one compression chamber of the at least one ram of the first support arrangement.

The first actuator may include a bi-directional pump and a motor to drive the pump. Alternatively, the first actuator may include a bi-directional pump and a motor-generator to drive and be driven by the pump.

The first adjustment accumulator may include a moveable wall between the gas chamber and the fluid chamber, and the first actuator may include the first adjustment accumulator and a first linear motor for at least driving the moveable wall to thereby vary the relative size of the gas and fluid chambers. The moveable wall may for example be a piston in a piston style accumulator or in a bellows or diaphragm type accumulator. The first linear motor for at least driving the moveable wall may be a motor-generator for driving and being driven by the moveable wall. Additionally or alternatively, the first linear motor may be a voice coil linear motor. The voice coil type of linear motor is typically actuable to provide an offset force, in this case on the moveable wall to increase or decrease the compression of the gas chamber of the adjustment accumulator. Alternatively, the first linear motor may be a lead screw driving the moveable wall. The lead screw type of linear motor is typically actuable to provide a displacement, in this case on the moveable wall to increase or decrease the compression of the gas chamber of the adjustment accumulator.

One or more forms of the present invention may further include: second, third and fourth support arrangements, each comprising one or more of the front left, front right, back left or back right support arrangements; a second actuator to transfer or effectively transfer fluid between the fluid chamber of a second adjustment accumulator and at least one compression chamber of a respective at least one ram of the second support arrangement; a third actuator to transfer or effectively transfer fluid between the fluid chamber of a third adjustment accumulator and at least one compression chamber of a respective at least one ram of the third support arrangement; and a fourth actuator to transfer or effectively transfer fluid between the fluid chamber of a fourth adjustment accumulator and at least one compression chamber of a respective at least one ram of the fourth support arrangement.

A static pressure in a gas chamber of the respective second, third or fourth adjustment accumulator may be within 25% of a static operating pressure in the at least one compression chamber of the at least one ram of the respective support arrangement. Alternatively, a static pressure in a gas chamber of the respective second, third or fourth adjustment accumulator may be within 20%, or 15%, or 10%, or 5% of a static operating pressure in the at least one compression chamber of the at least one ram of the respective support arrangement. Alternatively, a static pressure in a gas chamber of the respective second, third or fourth adjustment accumulator may be substantially equal to a static operating pressure in the at least one compression chamber of the at least one ram of the respective support arrangement.

In one or more forms of the present invention, the first support arrangement may comprise the front left support arrangement, the second support arrangement may comprise the front right support arrangement, the third support arrangement may comprise the back left support arrangement, and the fourth support arrangement may comprise the back right support arrangement. The at least one respective ram of each of the respective front left, front right, back left or back right support arrangements may be a respective single ram. The single ram in each of the front left, front right, back left or back right support arrangement may be a single-acting ram. Alternatively, the single ram in each of the respective front left, front right, back left or back right support arrangements may be a double-acting ram including a respective compression chamber and a respective rebound chamber, the front left compression chamber being connected to the front right rebound chamber, the front right compression chamber being connected to the front left rebound chamber, the back left compression chamber being connected to the back right rebound chamber, the back right compression chamber being connected to the back left rebound chamber.

Where second, third and fourth actuators and second, third and fourth adjustment accumulators are provided for the respective second third and fourth support arrangements, each of the respective front left, front right, back left and back right support arrangements may include two rams comprising a roll ram and a pitch ram, each ram including a respective compression chamber, the first support arrangement being a front pitch support arrangement including the compression chamber of the front left pitch ram and the compression chamber of the front right pitch ram, the second support arrangement being a back pitch support arrangement including the compression chamber of the back left pitch ram and the compression chamber of the back right pitch ram, the third support arrangement being a left roll support arrangement including the compression chamber of the front left roll ram and the compression chamber of the back left roll ram, and the fourth support arrangement being a right roll support arrangement including the compression chamber of the front right roll ram and the compression chamber of the back right roll ram.

Alternatively, in one or more forms of the present invention, each of the respective front left, front right, back left and back right support arrangements may include two rams comprising a roll ram and a pitch ram, each ram including a respective compression chamber, the first support arrangement being a front pitch support arrangement including the compression chamber of the front left pitch ram and the compression chamber of the front right pitch ram, a second support arrangement being a back pitch support arrangement including the compression chamber of the back left pitch ram and the compression chamber of the back right pitch ram, a third support arrangement being a left roll support arrangement including the compression chamber of the front left roll ram and the compression chamber of the back left roll ram, a fourth support arrangement being a right roll support arrangement including the compression chamber of the front right roll ram and the compression chamber of the back right roll ram.

Then, each of the respective front left, front right, back left and back right roll rams may be a double acting ram including a respective rebound chamber, the third support arrangement or left roll support arrangement may further include the rebound chamber of the front right roll ram and the rebound chamber of the back right roll ram, and the fourth support arrangement or right roll support arrangement may further include the rebound chamber of the front left roll ram and the rebound chamber of the back left roll ram. Alternatively or additionally, each of the respective front left, front right, back left and back right pitch rams may be a double acting ram including a respective rebound chamber, the first support arrangement or front pitch support arrangement may further include the rebound chamber of the back left pitch ram and the rebound chamber of the back right pitch ram, and the second support arrangement or back pitch support arrangement may further include the rebound chamber of the front left pitch ram and the rebound chamber of the front right pitch ram.

A second actuator may be provided to transfer or effectively transfer fluid between the fluid chamber of a second adjustment accumulator and at least one compression chamber of a respective at least one ram of the second support arrangement, a third actuator may be provided to transfer or effectively transfer fluid between the fluid chamber of a third adjustment accumulator and at least one compression chamber of a respective at least one ram of the third support arrangement, and a fourth actuator may be provided to transfer or effectively transfer fluid between the fluid chamber of a fourth adjustment accumulator and at least one compression chamber of a respective at least one ram of the fourth support arrangement. Alternatively, a second actuator may be provided to transfer or effectively transfer fluid between the fluid chamber of a second adjustment accumulator and at least one compression chamber of a respective at least one ram of the second support arrangement, and a third actuator may be provided to transfer or effectively transfer fluid between the at least one compression chamber of a respective at least one ram of the third support arrangement and at least one compression chamber of a respective at least one ram of the fourth support arrangement.

In one or more forms of the present invention, each of the respective front left, front right, back left and back right support arrangements may include two rams comprising a roll ram and a pitch ram, each ram including a respective compression chamber, the suspension system further including: a front pitch compression volume including the compression chamber of the front left pitch ram and the compression chamber of the front right pitch ram; a back pitch compression volume including the compression chamber of the back left pitch ram and the compression chamber of the back right pitch ram; a left roll compression volume including the compression chamber of the front left roll ram and the compression chamber of the back left roll ram; and a right roll compression volume including the compression chamber of the front right roll ram and the compression chamber of the back right roll ram.

Each of the respective front left, front right, back left and back right roll rams may be a double acting ram including a respective rebound chamber, the left roll compression volume further including the rebound chamber of the front right roll ram and the rebound chamber of the back right roll ram, the right roll compression volume further including the rebound chamber of the front left roll ram and the rebound chamber of the back left roll ram. Alternatively or additionally, each of the respective front left, front right, back left and back right pitch rams may be a double acting ram including a respective rebound chamber, the front pitch compression volume further including the rebound chamber of the back left pitch ram and the rebound chamber of the back right pitch ram, the back pitch compression volume further including the rebound chamber of the front left pitch ram and the rebound chamber of the front right pitch ram.

A heave device may be provided, forming the first support arrangement, the heave device comprising a heave piston assembly having four system volume pressure areas and a heave pressure area, the system volume pressure areas of the heave piston assembly being slidable inside respective system volume bores and being fixed relative to the heave pressure area of the heave piston assembly which is slidable inside a heave bore, the four system volume bores each being respectively connected to a respective one of the front pitch, back pitch, left roll and right roll compression volumes, the heave bore being connected to the first adjustment accumulator (for example, a heave adjustment accumulator), such that when the first actuator transfers fluid between the first adjustment accumulator and the heave bore, the heave piston assembly slides inside the heave and system volume bores, thereby effectively transferring fluid between the first adjustment accumulator the compression chambers of the pitch and roll rams of each of the front left, front right, back left and back right support arrangements.

A second (for example pitch) actuator may be provided to transfer or effectively transfer fluid between the front pitch compression volume and the back pitch compression volume, and a third (for example roll) actuator may be provided to transfer or effectively transfer fluid between the left roll compression volume and the right roll compression volume.

In one or more forms of the present invention, each of the respective front left, front right, back left and back right support arrangements may comprise a single respective single-acting ram, each ram including a respective compression chamber, the suspension system further including: a warp and heave device comprising: a first diagonal device connected to (for example, a first diagonal pair of the support arrangements being) the front left and back right rams; and a second diagonal device connected to (for example, a second diagonal pair of the support arrangements being) the front right and back left rams. Each diagonal device may include a first cylinder axially aligned with a second cylinder, the first cylinder including a piston connected to a rod extending into the second cylinder, forming first, second and third chambers, the rod being accommodated in the first and second chambers being a front system chamber and a back system chamber, the first and second chambers varying in volume in a common direction with motion of the piston and rod and varying in an opposite direction to the third chamber being a diagonal chamber, the front system chamber of the first diagonal device being connected to the compression chamber of the front left ram, the back system chamber of the first diagonal device being connected to the compression chamber of the back right ram, the front system chamber of the second diagonal device being connected to the compression chamber of the front right ram, the back system chamber of the second diagonal device being connected to the compression chamber of the back left ram, and the diagonal chamber of the first diagonal device being connected to the diagonal chamber of the second diagonal device forming a heave volume further including a heave resilience accumulator. This arrangement may allow for warp motions to compress the volume of the diagonal chamber of one of the first or second diagonal devices and increase the volume of the diagonal chamber of the other of the first or second diagonal devices, thus permitting free warp motions, by for example removing the warp stiffness of the rams of the support arrangements, such pure warp motions not requiring use of the heave resilience accumulator. This arrangement may also allow for heave motions to cause the diagonal chambers of both the first and second diagonal devices to compress or cause the diagonal chambers of both the first and second diagonal devices to increase in volume, such heave motions requiring the resilience of the heave resilience accumulator to accommodate the volume changes of the diagonal chambers of both the first and second diagonal devices. The first adjustment accumulator may be connected to the heave volume (either directly if for example the first adjustment accumulator incorporates the first actuator, or indirectly if for example the first actuator is connected between the heave volume and the first adjustment accumulator) such that when the first actuator transfers fluid between the first adjustment accumulator and the heave volume, the piston and rod in each diagonal device is displaced, effectively transferring fluid to the compression chambers of the front left, front right, back left and back right rams in the respective support arrangements. A pitch device may further be provided comprising three axially aligned cylinders, three pistons connected together by two rods each piston being disposed one to each cylinder to divide each cylinder and form a front pitch chamber, a front left chamber, a front right chamber, a back left chamber, a back right chamber and a back pitch chamber and a roll device may also be provided comprising three axially aligned cylinders, three pistons connected together by two rods forming a left roll chamber, a front left chamber, a front right chamber, a back left chamber, a back right chamber and a right roll chamber, the respective front left, front right back left and back right chambers of the pitch device and of the roll device being connected to the respective compression chambers of the respective rams.

A pitch actuator may be provided to transfer or effectively transfer fluid between the front pitch chamber and the back pitch chamber, and a roll actuator may be provided to transfer or effectively transfer fluid between the left roll chamber and the right roll chamber.

Another aspect of the present invention provides a method of controlling a suspension system for a multi-hulled vessel having a chassis and at least two hulls, the vessel further including front left, front right, back left and back right support arrangements between the chassis and the at least two hulls, each support arrangement including at least one ram having at least one compression chamber the method including the steps of: determining a control mode (for example: docking relative to a moving body such as a pontoon or docking relative to a fixed body such as a wharf or pylon in which cases any or all of the roll pitch and heave modes may be controlled; transit where roll and pitch may be the only controlled modes; or no powered control); sensing any one or more of a control switch position, at least one displacement (of for example a ram, a hull or the chassis), at least one velocity (of, for example a ram, a hull or the chassis), at least one acceleration (of, for example a ram, a hull or the chassis) and at least one force or pressure in the suspension system; controlling at least a first actuator configured to transfer or effectively transfer fluid from a first adjustment accumulator to the at least one compression chamber of the at least one ram of at least one of the support arrangements to adjust a heave, roll and/or pitch of the chassis (relative for example to the at least two hulls or a sensed water surface or other sensed positions such as markers on a pylon), a static pressure in the first adjustment accumulator being within 25% of a static pressure in the at least one compression chamber of the at least one ram of at least one of the support arrangements.

The method may further include the step of controlling the static pressure in the first adjustment accumulator (for example, to substantially equalise the static pressure in the first adjustment accumulator with the static pressure in the at least one compression chamber of the at least one ram of at least one of the support arrangements).

The method may further include, before controlling the static pressure in the first adjustment accumulator, any of the steps of: checking that the first actuator is not operating; checking that the vessel is in a substantially static or steady state condition; measuring a static, steady state or average pressure in the first adjustment accumulator and measuring a static, steady state or average pressure in the at least one compression chamber of the at least one ram of at least one of the support arrangements.

The step of controlling the static pressure in the first adjustment accumulator may include opening a valve in a bypass around the first actuator, the valve selectively communicating the first adjustment accumulator with the at least one compression chamber of the at least one ram of at least one of the support arrangements.

It will be convenient to further describe the invention by reference to the accompanying drawings which illustrate preferred aspects of the invention. Other embodiments of the invention are possible and consequently particularity of the accompanying drawings is not to be understood as superseding the generality of the preceding description of the invention.

DESCRIPTION OF PREFERRED EMBODIMENT

Figure 1:
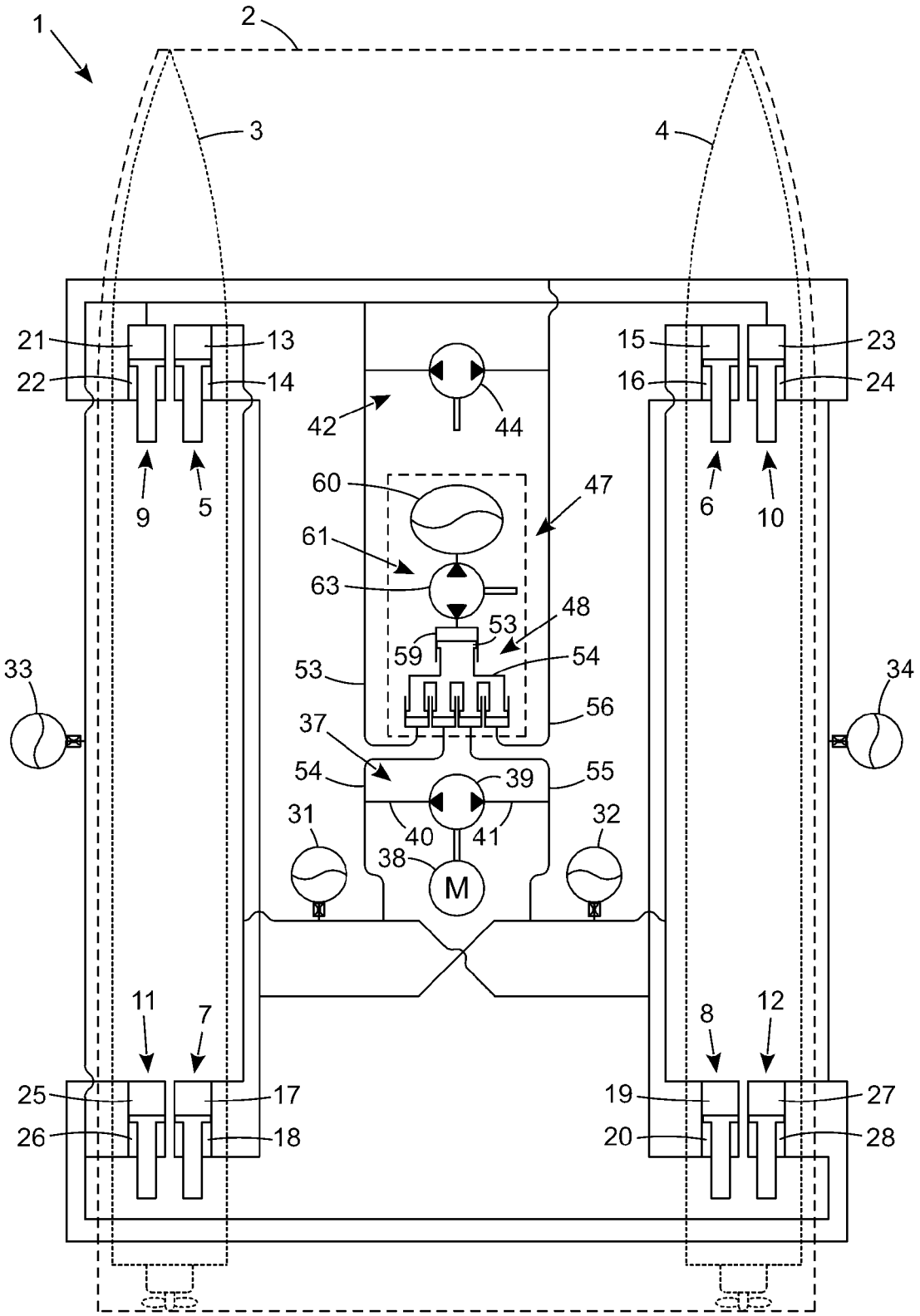
FIG. 1 is a schematic view of a catamaran incorporating a first possible form of the present invention.

Referring initially to FIG. 1, there is shown a plan view of a vessel 1 having a body or chassis 2, a left hull 3 and a right hull 4. An example of the suspension geometry providing location of the hulls relative to the body is disclosed in the applicant's international publication number WO 2013/181699, details of which are incorporated herein by reference. Towards the front and back of the left and right hulls are shown rams 5, 6, 7, 8, 9, 10, 11, 12 which form part of support arrangements between the hulls and the chassis. The support arrangements may together provide all of the support of the chassis, or if for example the chassis includes a hull portion or other wetted area that engages with the water, the support arrangements may provide only a portion of the support of the chassis.

In each of the respective front left, front right, back left and back right support arrangements is a respective roll ram 5, 6, 7, 8 and a respective pitch ram 9, 10, 11, 12. In this example each ram is double acting so includes a compression chamber 13, 15, 17, 19, 21, 23, 25, 27 and a rebound chamber 14, 16, 18, 20, 22, 24, 26, 28. The compression chambers 13, 17 of the front left 5 and back left 7 roll rams are in fluid communication with the rebound chambers 16, 20 of the front right 6 and back right 8 roll rams forming a left roll compression volume. A left roll compression (fluid pressure) accumulator 31 is connected to the left roll compression volume to provide resilience and may thus be referred to as a left roll compression resilience accumulator 31. Similarly, the compression chambers 15, 19 of the front right 6 and back right 8 roll rams are in fluid communication with the rebound chambers 14, 18 of the front left 5 and back left 7 roll rams forming a right roll compression volume to which is connected a right roll compression accumulator 32.

The compression chambers 21, 23 of the front left 9 and front right 10 pitch rams are in fluid communication with the rebound chambers 26, 28 of the back left 11 and back right 12 pitch rams forming a front pitch compression volume. A front pitch compression (fluid pressure) accumulator 33 is connected to the front pitch compression volume to provide resilience and may thus be referred to as a front pitch compression resilience accumulator. Similarly, the compression chambers 25, 27 of the back left 11 and back right 12 pitch rams are in fluid communication with the rebound chambers 22, 24 of the front left 9 and front right 10 pitch rams forming a back pitch compression volume to which is connected to a back pitch compression accumulator 34.

A roll actuator 37 including a driving device such as a (roll) motor 38 powering a bi-directional pump 39 allows fluid to be displaced along conduits 40, 41 between the left and right roll compression volumes to provide for example an active roll adjustment of the attitude of the chassis 2 relative to the hulls 3 and 4. In addition to converting energy (typically electrical energy) into motion of the pump and thereby roll of the vessel chassis, the roll actuator 37 can optionally also convert roll motions allowed to drive rotations of the bi-directional pump 39 into energy if for example the roll motor 38 is a motor-generator.

Similarly, a pitch actuator 42 including a driving device such as a (pitch) motor (not shown) powering a bi-directional pump 44 allows fluid to be displaced between the front and back pitch compression volumes to provide for example an active pitch adjustment of the attitude of the chassis 2 relative to the hulls 3 and 4.

Heave device 47 includes a heave displacer 48 comprising four system area pistons and a single large heave area piston 53, all five pistons being rigidly connected together in a heave piston assembly 54. Each system area piston slides inside a respective system bore and the heave area piston 53 slides inside a heave area bore 59, each system bore being connected to the respective system volume by a respective heave conduit, i.e. the front pitch compression bore of the heave device is connected by a front (pitch compression) heave conduit 53 to the front pitch compression volume; the left roll compression bore of the heave device is connected by a left (roll compression) heave conduit 54 to the left roll compression volume; the right roll compression bore of the heave device is connected by a right (roll compression)

heave conduit 55 to the right roll compression volume; and the back pitch compression bore of the heave device is connected by a back (pitch compression) heave conduit 56 to the back pitch compression volume.

Therefore as the heave piston assembly 54 displaces, fluid is displaced into or out of each of the respective compression volumes and out of or into a heave adjustment accumulator 60, which is connected to the heave bore 59 in which the heave area piston 53 slides via a heave actuator 61. The heave actuator 61 includes a (heave) motor (omitted for clarity) powering a bi-directional pump 63 to displace fluid between the heave adjustment accumulator 60 and the heave bore 59 to provide for example an active heave adjustment of the chassis 2 relative to the hulls 3 and 4. For example, if fluid is pumped from the heave adjustment accumulator 60 into the heave area bore 59, the volume formed by the heave area bore 59 and the heave area piston 53 is increased. Therefore the heave area piston 53 is axially displaced, as is the rest of the heave piston assembly 54. This causes the four individual volumes formed by the system area bores and the system area pistons to each reduce, displacing fluid into each of the main system volumes of the suspension system (i.e. into the left roll compression volume, right roll compression volume, front pitch compression volume, and back pitch compression volume). As the support provided by the rams is due to pressure acting over a compression piston face that is larger area than the annular face of the rebound side of the piston, then the pressure in the system compression volumes is related to the load supported by the rams and the rod diameters of the rams. If the load on each ram does not change, then the increase in fluid in all four of the main system volumes is accommodated by the ram chambers, expelling a corresponding volume of rod from the rams. This causes the roll rams 5, 6, 7, 8 and the pitch rams 9, 10, 11, 12 to all extend, raising the chassis 2 of the vessel relative to the hulls 3, 4. Similarly, pumping fluid from the heave area bore 59 into the heave adjustment accumulator 60 will lower the chassis 2 of the vessel relative to the hulls.

A primary benefit of using a pressurised heave adjustment accumulator rather than a tank of fluid at atmospheric pressure is that the static pressure differential between the heave adjustment accumulator 60 and the heave area bore 59 can be reduced. The static pressure in the heave area bore 59 is dependent in part on the magnitude of the sprung mass. For example a pressure of 70 bar may be required in the heave area bore 59 to ensure that the pressures in the main system volumes provide a sufficient total push-out force of the rams 5, 6, 7, 8, 9, 10, 11, 12 to support the mass of the chassis 2 for the vessel. If the heave pump 63 was connected to a tank of fluid at atmospheric pressure, it would need to generate fluid pressure in excess of 70 bar to enable the pressure in the heave area bore to be overcome and for fluid to be pumped into the heave area bore to increase the height (heave) of the chassis, i.e. in addition to any dynamic forces causing motion of the chassis, the heave pump would have to work against the constant load of gravity acting on the chassis, which consumes a considerable amount of energy. Conversely, when releasing fluid from the heave area bore into a tank at atmospheric pressure, the energy of the fluid pressure being released is largely lost, typically through damping. Even if the heave actuator includes a motor generator to extract energy from the release of pressurised fluid to a tank, the losses are not insignificant due to the magnitude of energy involved with working against both dynamic and gravitational forces when using a heave adjustment tank at atmospheric pressure. So the heave adjustment accumulator 60 can have an operating pressure that reduces or minimises the static pressure differential across the heave actuator. A significant advantage can be gained over using a conventional supply fluid tank at atmospheric pressure by using an adjustment accumulator 60 that has a pressure within 25% of the static operating pressure of the volume it is directly controlling by the pump 53, in this case the fluid inside the heave bore 59. Further advantages are gained by using an adjustment accumulator at a closer pressure to the static operating pressure of the volume being controlled, such as within 20%, or more preferably within 15% or more preferably within 10% or more preferably within 5% with the ideal being equal static pressure in the adjustment accumulator and the volume being controlled. Ideally, the heave adjustment accumulator 60 has an operating pressure that balances the heave piston assembly 54 at a chosen condition such as vessel ride height for example, or mid-stroke travel of the suspension system, as if the heave bore 59 were directly connected to the accumulator 60. Such a substantial reduction or removal of the static pressure differential across the heave pump 63 due to gravitational force on the chassis 2 greatly increases the efficiency of any heave compensation motions.

Figure 2:
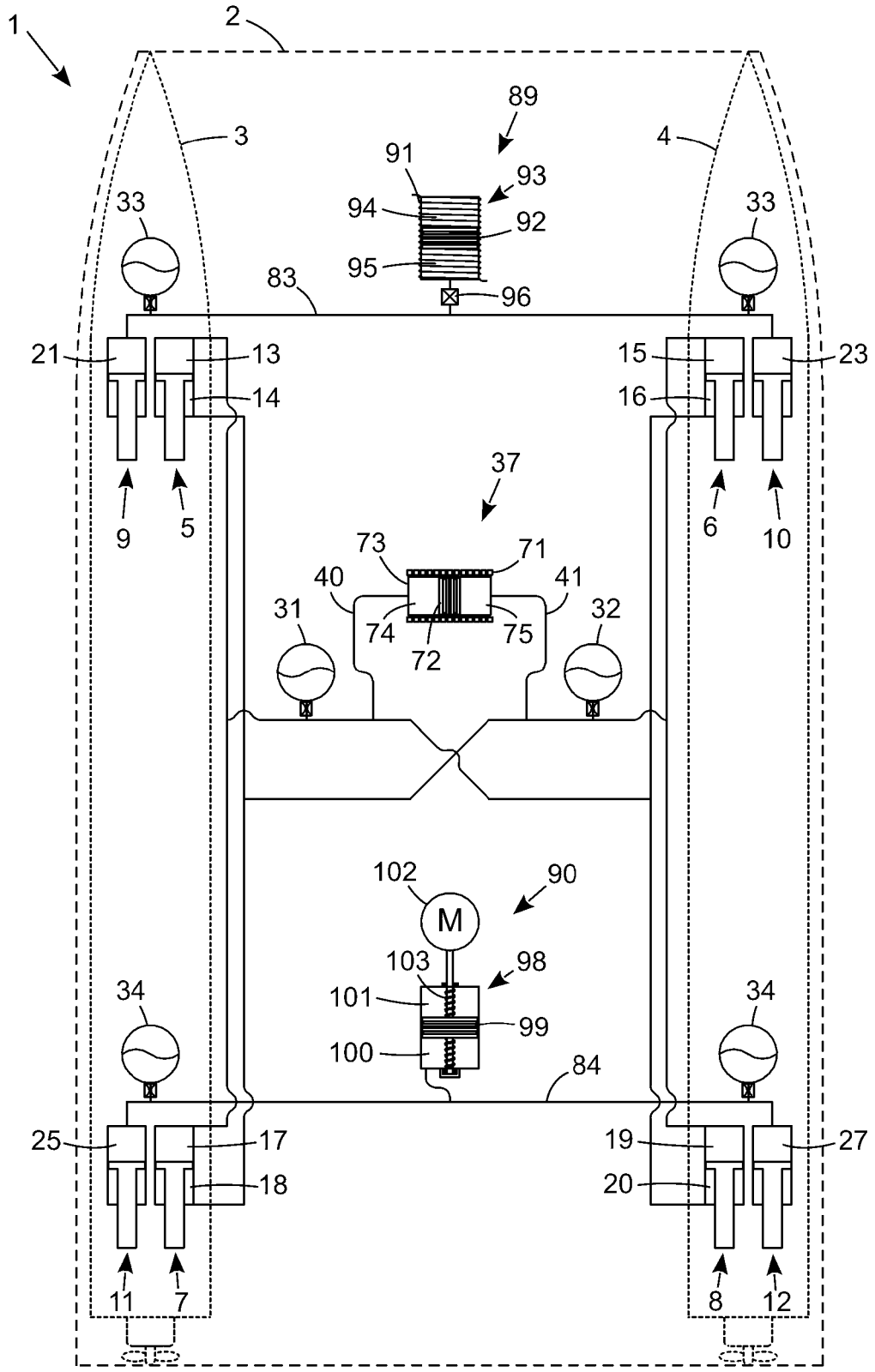
FIG. 2 is a schematic view of a second possible form of the present invention.

Alternative embodiments of the present invention are now discussed. Throughout the drawings, equivalent parts are given like reference numerals. In FIG. 2 the roll rams and roll compression volumes are unchanged from FIG. 1. However the roll actuator 37 is now a linear motor 71 powering a piston 72, the piston is slidable inside a cylinder 73, separating the cylinder into a left roll chamber 74 and a right roll volume chamber 75, such that powering the piston 72 axially inside the roll cylinder 73 generates an effective displacement of fluid between the roll compression volumes (i.e. from one roll compression volume to the other and vice versa).

The pitch rams in FIG. 2 are single-acting rams (i.e. having only a compression chamber). The compression chamber 21 of the front left pitch ram 9 is in fluid communication with the compression chamber 23 of the front right pitch ram 10 by a front pitch compression conduit 83 forming a front pitch compression volume. Similarly, the compression chamber 25 of the back left pitch ram 11 is in fluid communication with the compression chamber 27 of the back right pitch ram 12 by a back pitch compression conduit 84 forming a back pitch compression volume. A front heave actuator 89 is connected to the front pitch compression volume and a back heave actuator 90 is connected to the back pitch compression volume. If both the front and back heave actuators 89 and 90 are controlled to increase the volume of fluid in the front and back pitch compression volumes then the chassis 2 can be adjusted in in a pure heave mode (i.e. the front and the back can be adjusted in height by the same amount). However if, for example, just the front heave actuator is used to adjust the volume of fluid in the front pitch compression volume, then the chassis 2 will be raised or lowered at the front end only, so the adjustment to the chassis will overall involve a heave motion component and a pitch motion component. Conversely, if the front and back heave actuators 89 and 90 are used to drive the opposite ends of the chassis 2 in opposite directions (such as the front upwards and the rear downwards relative to the hulls) then it is possible for a pure pitch motion of the chassis to result with no change in heave displacement of the chassis centre of mass for example).

The front heave actuator 89 comprises a voice coil type linear motor 91 which generates a force on the piston 92 (or similar moveable wall) of a front heave adjustment accumulator 93. The piston 92 divides the accumulator 93 into the fluid chamber 94 and gas chamber 95 typical of a fluid pressure accumulator. The front heave adjustment accumulator 93 is again preferably at a similar static pressure to the operating pressure of the associated system volume, in this case the front pitch compression volume. The piston 92 is able to slide axially so if the voice coil motor 91 is not driven or loaded to influence the position of the piston 92, the adjustment accumulator 93 will act like a conventional piston accumulator, providing resilience to the associated system volume.

Front pitch compression accumulators 33 are in this case optional but shown here connected to the front pitch compression volume to provide resilience, in which case the resilience provided by the front heave adjustment accumulator 89 can be locked off or heavily restricted (so the static pressure in the accumulator and the system volume remain similar) using valve 96.

Various forms of linear motor are known, the coil shown here being a simplification for the purposes of drawing clarity. By supplying appropriate currents to the voice coil 91 or applying a load across it, driving or damping forces can be exerted on the piston 92. This is in contrast to other forms of actuator in the present invention. The benefit of using a linear actuator to apply a force to the piston of an accumulator that is acting as both a resilience accumulator and an adjustment accumulator is that oscillating motions can be readily controlled and as the heave position of the chassis will not vary very far on average (although waves will cause oscillations around this average heave position) and the need for separate adjustment and resilience accumulators can be negated. The disadvantage of such a force-type actuator rather than a displacement-type actuator is that in the many situations where a constant displacement is required for a period, either while maneuvering (turning, accelerating, decelerating, transitioning from planing to displacement operation of the hulls, etc.) a force must be continually generated to compensate the chassis position for sustained dynamic loads. The valve 96 can be used to assist in these situations, but then separate resilient accumulators such as shown at 33 would be required.

An alternative arrangement of heave actuator 90 is shown on the back pitch volume in FIG. 2, being a displacement-type actuator. Although the back heave actuator 90 is built into the back heave adjustment accumulator 98 the piston 99 is not free to move, so the adjustment accumulator 98 can never act as a resilient accumulator. Therefore back pitch compression accumulators 34 are connected to the back pitch compression volume to provide resilience. The piston 99 separates the adjustment accumulator 98 into a fluid chamber 100 and a gas chamber 101. The gas chamber 101 may include a flexible annular container (not shown) such as an annular bellows or bag to contain the gas and reduce the need for adjustment or frequency of servicing of the gas pressure or volume in the gas chamber 101. Similarly the fluid chamber 100 may include a flexible form of annular container to improve sealing, the flexible container being in fluid communication with the back pitch compression volume. The back heave actuator 90 incorporates a back heave motor 102 driving a lead screw type linear motion device 103 which controls the axial displacement of the piston 99.

Ideally the gas chamber 101 of the back heave adjustment accumulator 98 has a significant pressure pre-charge, so as discussed above in relation to the heave adjustment accumulator 60 of FIG. 1, the motor 102 has to provide the required force to displace fluid into or out of the system volume (in this case the back pitch compression volume) to compensate for dynamic motions of the back pitch rams but does not have to work against a high pre-load force, for example due to the constant (static) gravitational loads on the back pitch rams.

The respective front heave actuator 89 and the back heave actuator 90 can be used to individually adjust the respective front or back height of the chassis relative to the hulls to thereby provide pitch and heave adjustment.

Figure 3:
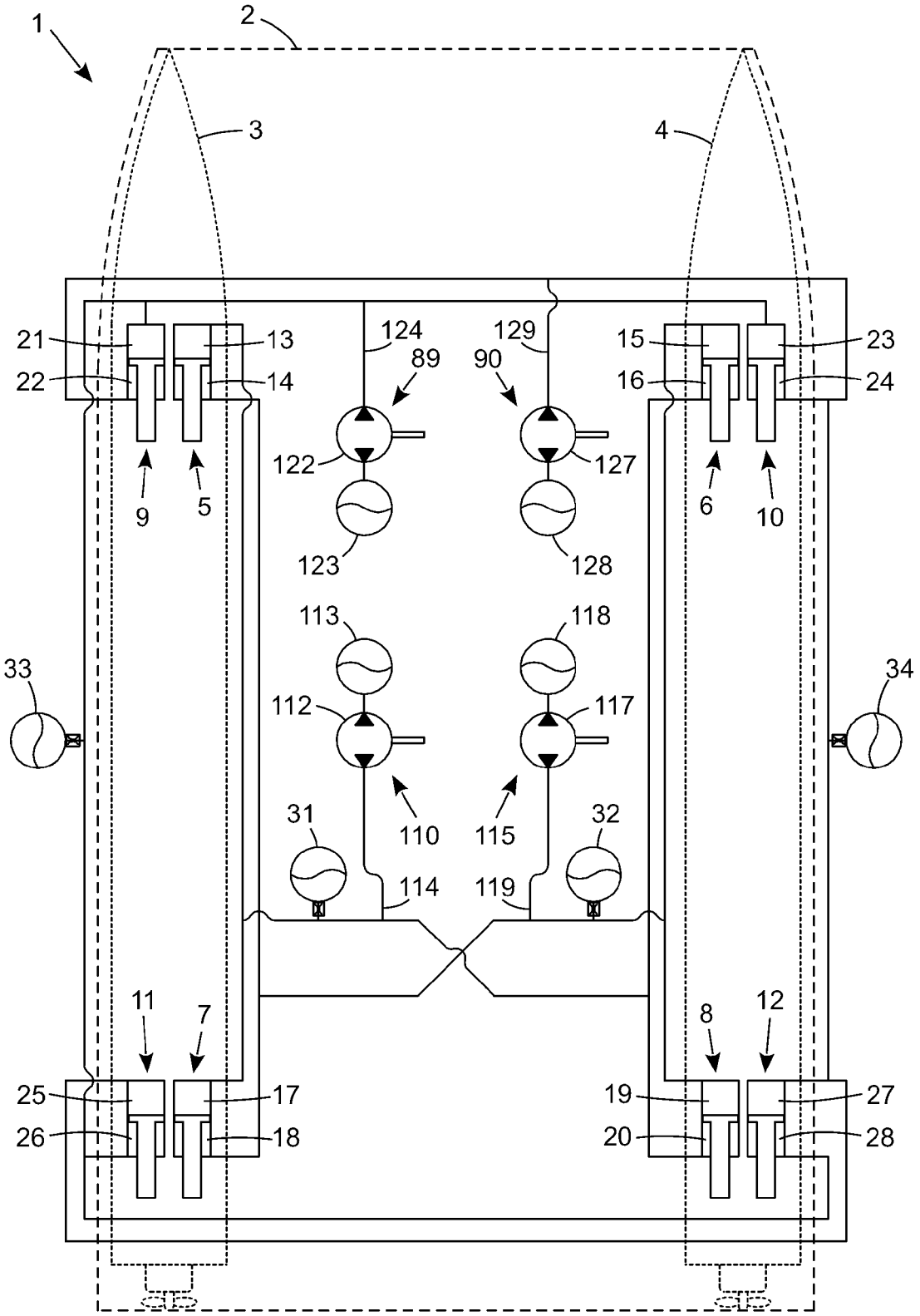
FIG. 3 is a schematic view of a third possible form of the present invention.

FIG. 3 shows a similar arrangement of double-acting roll and double-acting pitch rams as in FIG. 1 forming left and right roll compression volumes and front and back pitch compression volumes. However in this example in FIG. 3 there is a respective actuator for each volume. The left (roll or heave) actuator 110 includes a left (roll or heave) motor (omitted for clarity) to drive a left (roll or heave) bi-directional pump 112 for driving fluid flow between the left (roll or heave) adjustment accumulator 113 and the left roll compression volume. Similarly the right (roll or heave) actuator 115 includes a right (roll or heave) motor (omitted for clarity) to drive a right (roll or heave) bi-directional pump 117 for driving fluid flow between the right (roll or heave) adjustment accumulator 118 and the right roll compression volume.

The components 110, 112, 113 and 115, 117, 118 are designated as roll or heave components by their naming above since they enable adjustments in both the roll and heave modes, so it may be convenient to refer to them as simply left or right height adjustment components. For example, to roll the chassis 2 to the left (lowering the left side and raising the right side) relative to the left and right hulls 3, 4, the left height adjustment pump 112 is powered to drive fluid out of the left roll compression volume, along conduit 114 into the left height adjustment accumulator 113, and the right height adjustment pump 117 is powered to drive fluid along conduit 119 into the right roll compression volume from the right height adjustment accumulator 118. To adjust the heave position of the chassis 2 upwards relative to the left and right hulls 3, 4, the left and right height adjustment pumps 112, 117 can be powered to drive fluid out of the left and right height adjustment accumulators 113, 118 along the conduits 114, 119 into the left and right roll compression volumes. If this is done with no change to the front and back pitch compression volumes, then the proportion of the sprung mass supported on the roll rams 5, 6, 7, 8 is increased and the proportion of the sprung mass supported on the pitch rams 9, 10, 11, 12 is correspondingly reduced.

The front (pitch or heave) actuator 89 includes a front (pitch or heave) motor (omitted for clarity) to drive a front (pitch or heave) bi-directional pump 122 for driving fluid flow between the front (pitch or heave) adjustment accumulator 123 and the front pitch compression volume. Similarly the back (pitch or heave) actuator 90 includes a back (pitch or heave) motor (omitted for clarity) to drive a back (pitch or heave) bi-directional pump 127 for driving fluid flow between the back (pitch or heave) adjustment accumulator 128 and the back pitch compression volume.

The components 89, 122, 123 and 90, 127, 128 are designated as pitch or heave components by their naming above since they enable adjustments in both the pitch and heave modes, so it may be convenient to refer to them as simply front or back height adjustment components. For example, to pitch the chassis 2 to the front (lowering the front and raising the rear) relative to the hulls 3, 4, the front height adjustment pump 122 is powered to drive fluid out of the front pitch compression volume, along conduit 124 into the front height adjustment accumulator 123, and the back height adjustment pump 127 is powered to drive fluid along conduit 129 into the back pitch compression volume from the back height adjustment accumulator 128. To adjust the heave position of the chassis 2 upwards relative to the left and right hulls 3, 4, the front and back height adjustment pumps 122, 127 can be powered to drive fluid out of the front and back height adjustment accumulators 123, 128 along the conduits 124, 129 into the front and back pitch compression volumes. If this is done with no change to the left and right roll compression volumes, then the proportion of the sprung mass supported on the pitch rams 9, 10, 11, 12 is increased and the proportion of the sprung mass supported on the roll rams 5, 6, 7, 8 is correspondingly reduced.

To adjust the heave of the vessel in response to dynamic inputs, without changing the proportion of the sprung mass supported on the roll versus pitch rams, both left and right height adjustment pumps 112, 117 drive fluid into the roll compression volumes from the left and right height adjustment accumulators 113, 118 and both front and back height adjustment pumps 122, 127 drive fluid into the pitch compression volumes from the front and back height adjustment accumulators 123, 128 to raise the chassis relative to the hulls; or conversely to lower the chassis both left and right height adjustment pumps 112, 117 drive fluid from the roll compression volumes into the left and right height adjustment accumulators 113, 118 and both front and back height adjustment pumps 122, 127 drive fluid from the pitch compression volumes into the front and back height adjustment accumulators 123, 128.

The preceding suspension arrangements according to various embodiments of the present invention are also applicable to vessels having other numbers of hulls, such as the following quadmaran with four hulls moveable relative to the chassis, discussed with reference to FIG. 4. Similarly the suspension arrangements shown in the following Figures are also applicable to vessels having two hulls moveable relative to the chassis.

Figure 4:
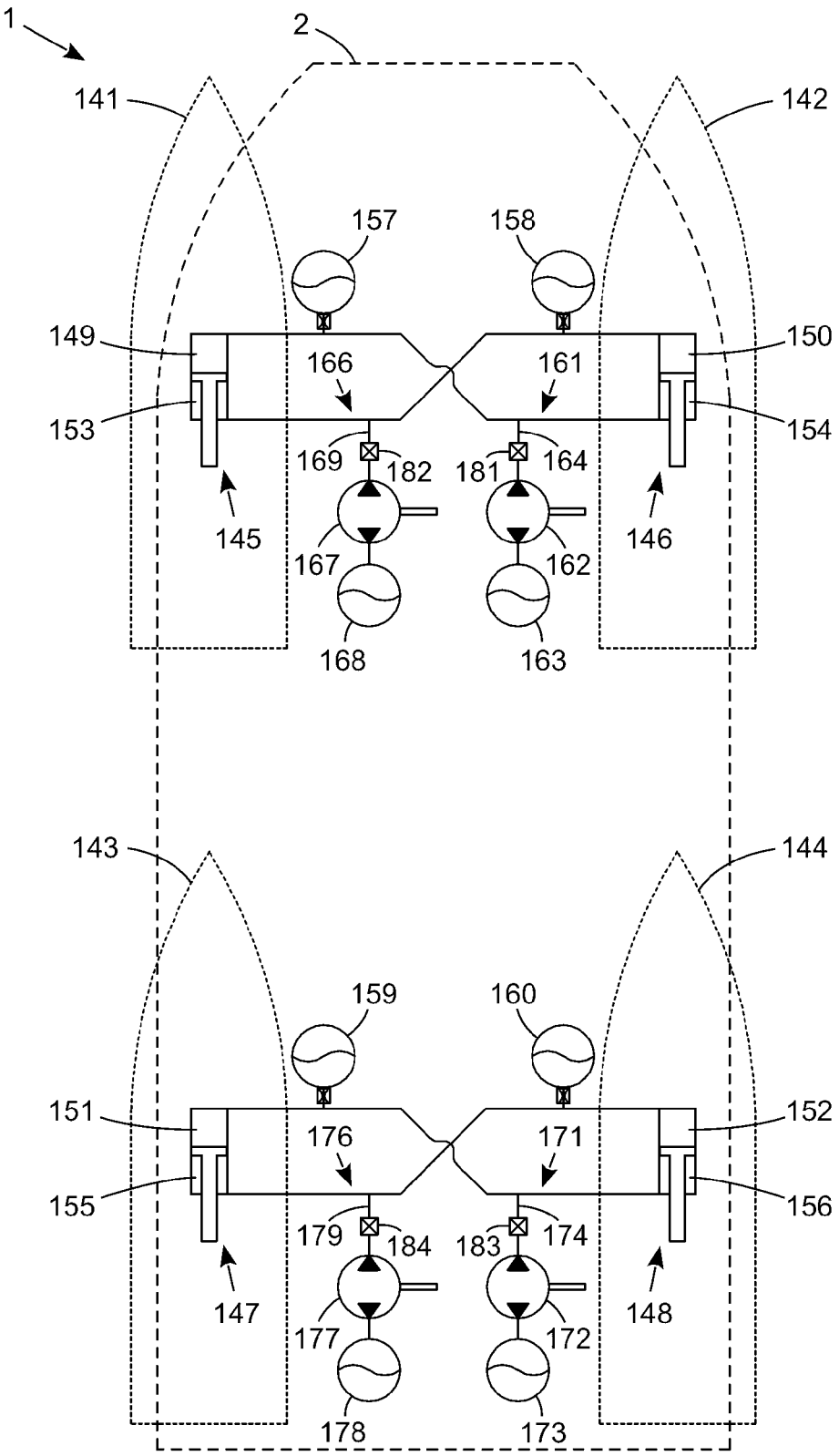
FIG. 4 is a schematic view of a quadmaran incorporating a fourth possible form of the present invention.

FIG. 4 shows a quadmaran having a body portion or chassis 2 at least partially supported relative to four individual hulls (a front left hull 141, a front right hull 142, a back left hull 143 and a back right hull 144). Each (front left, front right, back left, or back right) support arrangement includes a double-acting ram 145, 146, 147 or 148, respectively. A compression chamber 149 of the front left ram 145 is connected to a rebound chamber 154 of the front right ram 146 forming a front left compression volume to which is connected a front left (resilience) accumulator 157 for providing resilience. Similarly, the compression chamber 150 of the front right ram 146 is connected to the rebound chamber 153 of the front left ram 145 forming a front right compression volume to which is connected a front right (resilience) accumulator 158; the compression chamber 151 of the back left ram 147 is connected to the rebound chamber 156 of the back right ram 148 forming a back left compression volume to which is connected a back left (resilience) accumulator 159; and the compression chamber 152 of the back right ram 148 is connected to the rebound chamber 155 of the back left ram 147 forming a back right compression volume to which is connected a back right (resilience) accumulator 160.

The front left compression volume can be adjusted by a front left height adjustment actuator 161 including a pump 162 to drive fluid along conduit 164 from or to a front left adjustment accumulator 163; the front right compression volume can be adjusted by a front right height adjustment actuator 166 including a pump 167 to drive fluid along conduit 169 from or to a front right adjustment accumulator 168; the back left compression volume can be adjusted by a back left height adjustment actuator 171 including a pump 172 to drive fluid along conduit 174 from or to a back left adjustment accumulator 173; and the back right compression volume can be adjusted by a back right height adjustment actuator 176 including a pump 177 to drive fluid along conduit 179 from or to a back right adjustment accumulator 178.

An optional valve 181, 182, 183, 184 is shown in the respective actuator conduit 164, 169, 174, 179. Alternatively (or additionally) each pump may be connected to a motor-generator so that electrical energy can be generated from flow through the conduits 164, 169, 174, 179 as well as used to generate flow through the conduits.

All four pumps must be operated to adjust any one of the pure roll, pitch or heave modes of the chassis relative to the four hulls. For example, if the front left and front right pumps 162, 167 are used to adjust the front left and front right compression volumes to increase the height of the front of the vessel chassis 2 relative to the hulls, but without any adjustment of the back compression volumes, then both the pitch and heave attitude of the chassis are adjusted relative to the hulls. The roll of the front rams 145 and 146 is now separate to the roll of the rear rams 147 and 148, so to avoid generating unwanted torsional inputs to the chassis or to provide a desired distribution of roll forces between the front and the rear rams, the pressure in the four compression volumes is a useful control input.

These front and rear pairs of cross-connected double-acting rams in FIG. 4 provide a higher roll stiffness than heave stiffness, but provide a warp stiffness whereas the arrangements in FIGS. 1 to 3 and FIG. 6 typically provide substantially zero warp stiffness.

Figure 5:
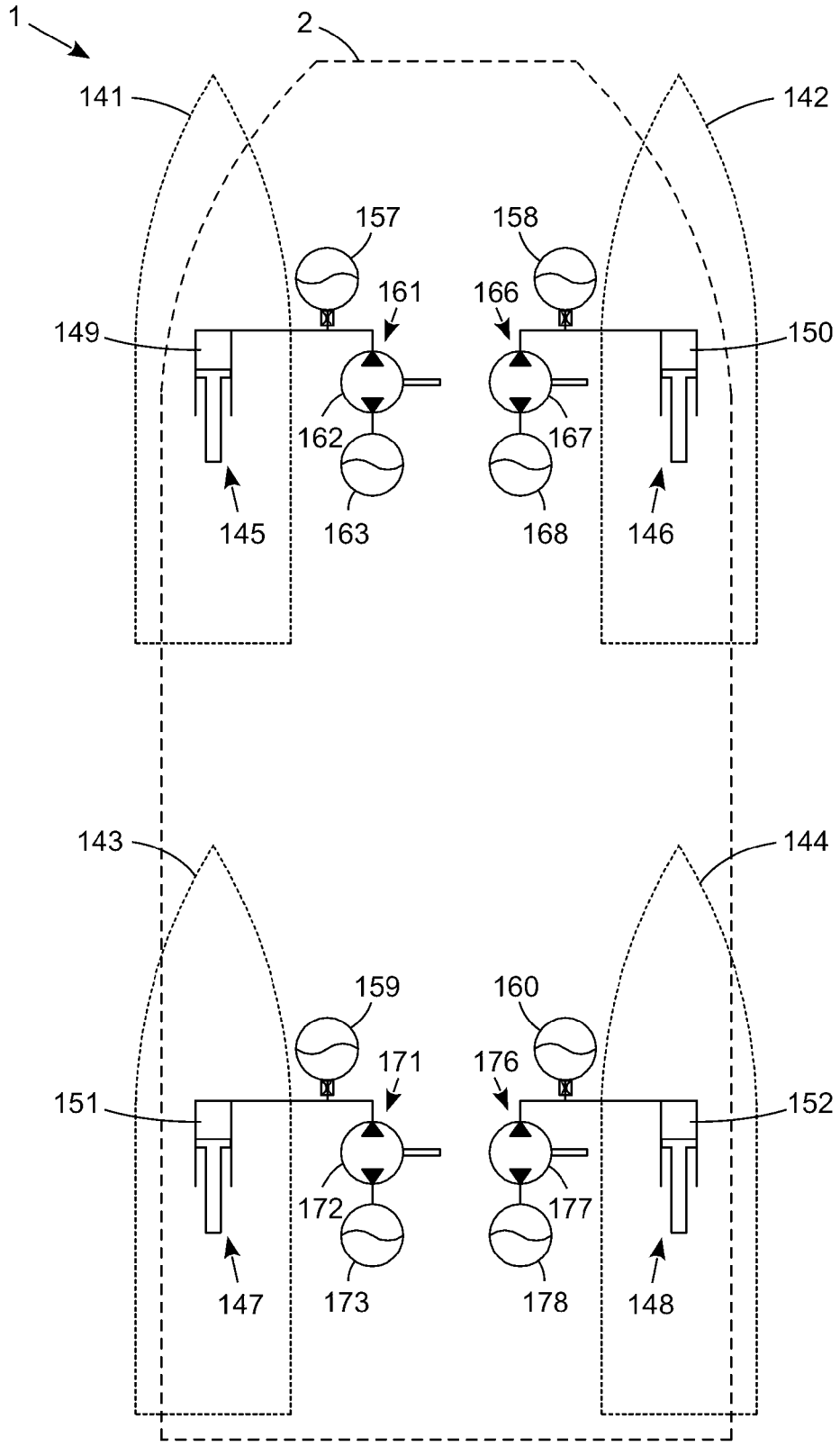
FIG. 5 is a schematic view of a fifth possible form of the present invention.

Alternatively, each compression volume may only comprise a single compression chamber 149, 150, 151 or 152 and an accumulator 157, 158, 159 or 160 for resilience, i.e. if as shown in FIG. 5, each of the front left, front right, back left and back right rams 145, 146, 147, 148 is effectively single-acting, without any interconnections between the four support arrangements, then the ram arrangement provides the same roll, pitch, warp and heave stiffness. While the roll, pitch and heave could be controlled as discussed in relation to FIG. 4, warp control to reduce or minimise torsional inputs into the chassis can add complexity to the control although the number of rams and conduits is reduced.

Figure 6:
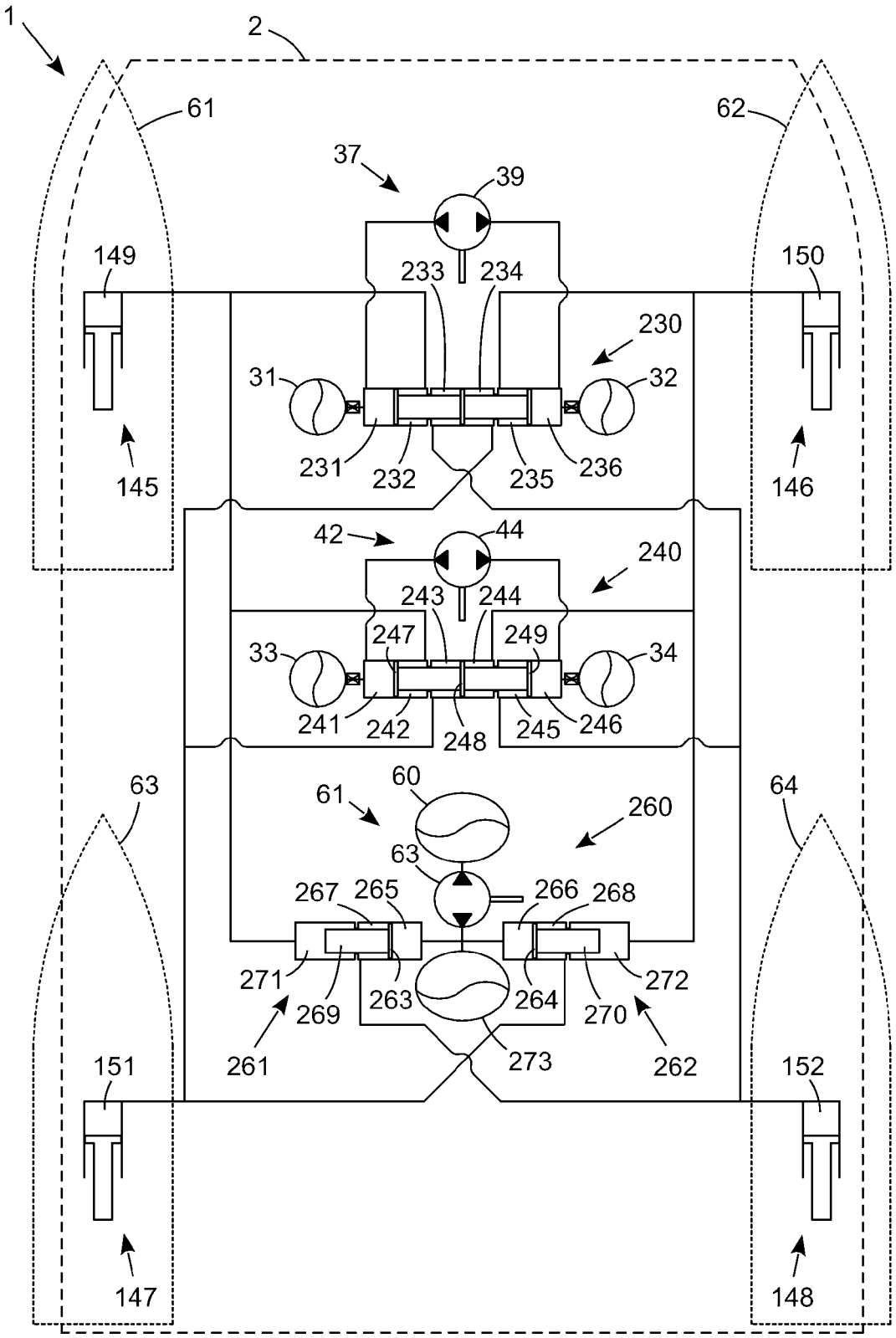
FIG. 6 is a schematic view of a sixth possible form of the present invention.

The suspension system shown in FIG. 6 uses one single-acting ram 145, 146, 147, 148 in each support arrangement. Each ram is connected to a roll device 230, a pitch device 240 and a heave and warp device 260, each device including one or more respective accumulators to provide compliance in the relevant mode.

The roll device 230 includes three axially aligned cylinders, each separated by a respective piston into two chambers, the three pistons (one in each of the three cylinders) being rigidly connected by rods forming a piston rod assembly. The compression chamber 149 of the front left ram 145 is connected to the front left roll chamber 232 of the roll device 230; the compression chamber 150 of the front right ram 146 is connected to the front right roll chamber 235; the compression chamber 151 of the back left ram 147 is connected to the back left roll chamber 234; and the compression chamber 152 of the back right ram 148 is connected to the back right roll chamber 233.

As the front left roll chamber 232 and the back left roll chamber 234 expand with motion of the piston rod assembly, the left roll compression chamber 231 of the roll device 230 contracts in size, expelling fluid into the left roll compression accumulator 31, increasing its pressure and therefore the pressure in the left roll compression chamber 231. The right roll compression chamber 236 correspondingly increases in size, fluid being supplied from the right roll compression accumulator 32 reducing its pressure and the pressure in the right roll compression accumulator. The change in pressures in the roll compression chambers 231 and 236 is reacted by a change in the pressures in the system roll chambers in the roll device 230, with the front left and back left roll chambers 232, 234 increasing in pressure and the front right and back right roll chambers 235, 233 decreasing in pressure. This mechanism provides an increase in roll moment with roll displacement, i.e. a roll stiffness. Similarly, as the front right roll chamber 235 and back right roll chamber 233 expand with motion of the piston rod assembly, the right roll compression chamber 236 of the roll device 230 contracts in size, expelling fluid into the right roll compression accumulator 32. Although all three cylinders of the roll device 230 are shown the same size in FIG. 6, changing the diameter of the centre cylinder relative to the end cylinders changes the distribution of roll loads and warp displacements between the front and back rams.

The pitch device 240 similarly includes three axially aligned cylinders, each separated by a piston 247, 248, 249 into two chambers 241 and 242; 243 and 244; 245 and 246, the three pistons in the three cylinders being rigidly connected by rods forming a piston rod assembly. The compression chamber 149 of the front left ram 145 is connected to the front left pitch chamber 242 of the pitch device 240; the compression chamber 150 of the front right ram 146 is connected to the front right pitch chamber 244; the compression chamber 151 of the back left ram 147 is connected to the back left pitch chamber 243; and the compression chamber 152 of the back right ram 148 is connected to the back right pitch chamber 245.

As the front left pitch chamber 242 and the front right pitch chamber 244 expand with motion of the piston rod assembly, the front pitch compression chamber 241 of the pitch device 240 contracts in size, expelling fluid into the front pitch compression accumulator 33. Similarly, as the back left pitch chamber 243 and back right pitch chamber 245 expand with motion of the piston rod assembly, the back pitch compression chamber 246 of the pitch device 240 contracts in size, expelling fluid into the back pitch compression accumulator 34. As with the roll device, in the pitch device a displacement of the piston rod assembly generates a change in pressures, with the pitch device providing an increase in pitch moment on the vessel with pitch displacement, i.e. a pitch stiffness.

The heave and warp device 260 includes a first pair of axially aligned cylinders 261 and a second pair of axially aligned cylinders 262. One cylinder of each pair includes a piston 263 or 264 separating the one cylinder into two chambers 265 and 267 or 266 and 268, each piston 263 or 264 being rigidly connected to a respective rod 269 or 270 protruding into the other cylinder of the respective pair. The compression chamber 149 of the front left ram 145 is connected to the front left heave chamber 271 in the first pair of axially aligned cylinders 261 of the warp and heave device 260. The other chamber in the first pair of axially aligned cylinders which varies in volume in the same direction as the front left heave chamber 271 with motion of the piston 263 and rod 269 is the back right heave chamber 267 and is connected to the compression chamber 152 of the back right ram 148. Thus when the front left ram 145 and back right ram 148 (i.e. a first diagonal pair of rams) are compressed, fluid is expelled from their compression chambers 149, 152 into the front left heave chamber 271 and the back right heave chamber 267, expanding those chambers and displacing the piston rod assembly such that the first diagonal heave chamber 265 is compressed. Similarly, the compression chamber 150 of the front right ram 146 is connected to the front right heave chamber 272 in the second pair of axially aligned cylinders 262 of the warp and heave device 260. The other chamber in the second pair of axially aligned cylinders which varies in volume in the same direction as the front right heave chamber with motion of the piston 264 and rod 270 is the back left heave chamber 268 and is connected to the compression chamber 151 of the back left ram 147. Thus when the front right ram 146 and back left ram 147 (i.e. a second diagonal pair of rams) are compressed, fluid is expelled from their compression chambers 150, 151 into the front right heave chamber 272 and the back left heave chamber 268, expanding those chambers and displacing the piston rod assembly such that the second diagonal heave chamber 266 is compressed.

During a warp motion of the rams 145, 146, 147, 148 of the suspension system, for example when the first diagonal pair of (front left, back right) rams are compressed and the second diagonal pair of (front right, back left) rams are extended, fluid is displaced between the first and second diagonal heave chambers 265, 266, so any pressure changes are minimised, as are load changes in the four rams 145, 146, 147, 148, i.e. there is substantially no warp stiffness. However during a heave motion of the rams 145, 146, 147, 148 of the suspension system, for example when all the rams are compressed, fluid is displaced out of both the first and second diagonal heave chambers 265, 266 into the heave resilience accumulator 273.

Such arrangements are discussed in more detail in the applicant's international publication numbers WO 2011/143692 and WO 2011/143694 details of which are incorporated herein by reference. In this arrangement, as in the arrangement of FIG. 1, where the warp mode of the hydraulic suspension system has substantially no stiffness, the other three modes can be individually adjusted using respective actuators. The roll actuator 37 includes a roll pump 39 connected between the left and right roll compression chambers 231, 236 of the roll device 230. While there may be a difference between the static pressures in the left and right roll compression chambers due to a lateral offset load on the vessel for example, the magnitude of pressure differential is typically much lower than the differential between either of the roll compression chamber pressures and atmospheric pressure. The pitch actuator 42 includes a pitch pump 44 connected between the front and back pitch compression chambers 241, 246 of the pitch device 240. While there may be a difference between the static pressures in the front and back pitch compression chambers due to a difference in front to rear load on the vessel for example (or even suspension geometry effects such as the mechanical advantage on rams), the magnitude of pressure differential is typically much lower than the differential between either of the pitch compression chamber pressures and atmospheric pressure. The heave actuator 61 includes a heave pump 63 connected to the heave and warp device 260. As in FIG. 1 a heave adjustment accumulator 60 is provided to reduce or minimise the static pressure differential across the heave pump 63 (between the fluid in the heave adjustment accumulator and the fluid in the first and second diagonal heave chambers 265, 266). The arrangement of rams and modal (roll, pitch and heave/warp) devices of FIG. 6 has an inherent zero warp stiffness.

Figure 7:
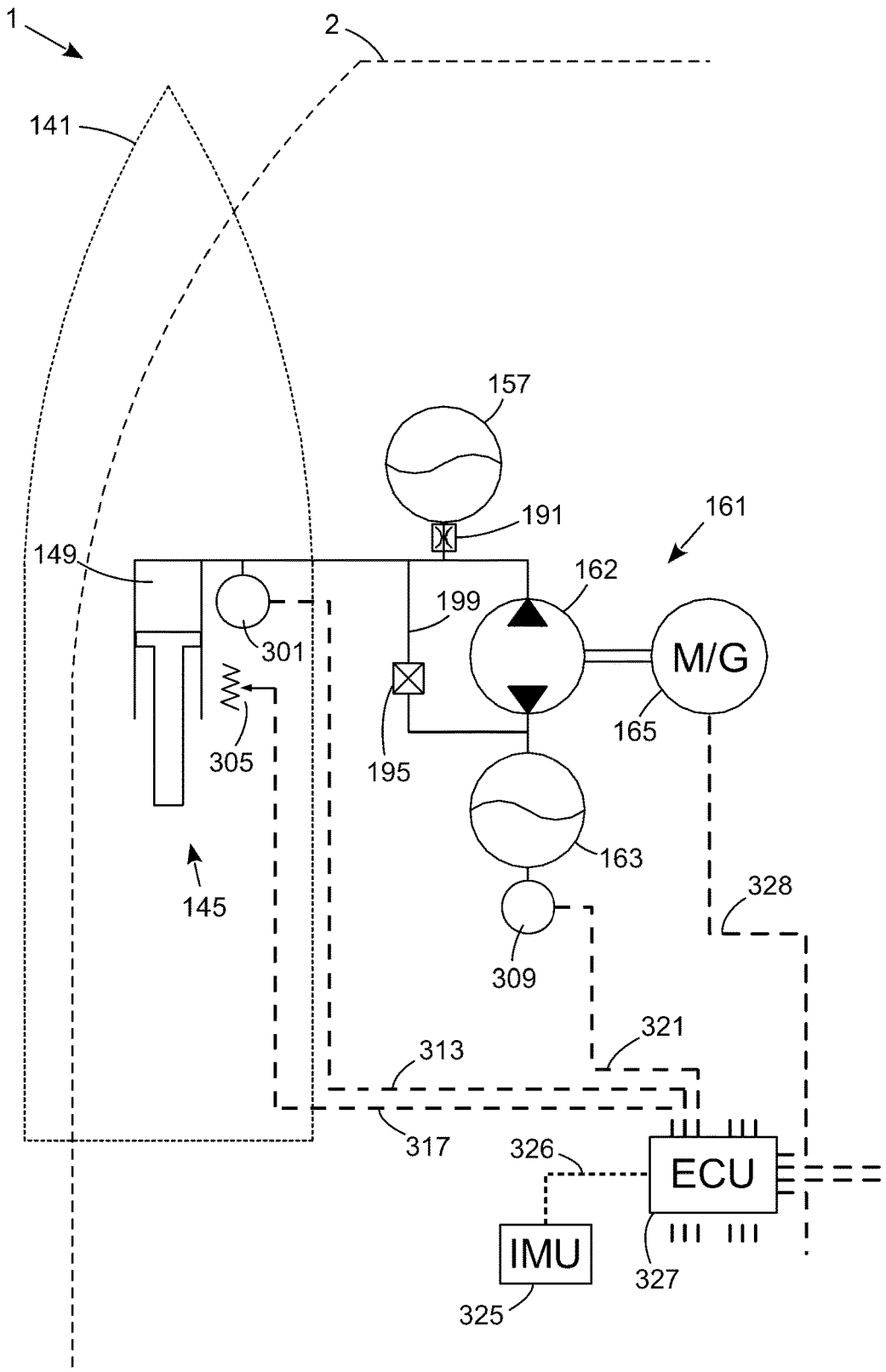
FIG. 7 is a schematic view of a support arrangement according to one form of the present invention.

FIG. 7 shows a support arrangement towards the front left corner of the vessel, along with associated sensing and control elements. The example is taken from a corner of the suspension system shown in FIG. 5 with the motor or other drive device 165 shown for the bi-directional pump 162. In this example the drive device is a motor-generator, i.e. it can convert electrical energy into rotational motion to drive the pump 162, or convert rotational motion of the pump 162 into electrical energy.

A pressure transducer 301 is connected to the front left system volume (including compression chamber 149 of front left ram 145) which can be used for example with other system pressure transducers to determine the warp load in this independent support arrangement. The pressure transducer 301 can also be used together with the adjustment accumulator pressure transducer 309 to determine when the pressure may need to be equalised between system volume and adjustment accumulator. The position sensor 305 generates an input to the Electronic Control Unit (ECU) 327 indicative of the front left ram stroke position, i.e. the displacement position of the front left ram 145. Each sensor from the front left support arrangement is communicated back to the ECU by electrical lines 313, 317, 321, as are similar sensors from the other three support arrangements (front right, back left and back right). An Inertial Measurement Unit (IMU) 325 fixed to the chassis and typically able to output chassis accelerations, along with calculated velocities and displacements in a reference system relative to the ground or the chassis is also connected to the ECU 327 by electrical line 326. The ECU can then calculate a desired output to control the relevant actuator, in this case using electrical line 328 to the front left drive device 165. The use of electrical lines is just used here to indicate the ability to transfer data and control signals electrically or electronically. Typically a CAN (controller area network) bus is actually used to transfer multiple signals significant distances around a vessel with high fidelity.

Figure 8:
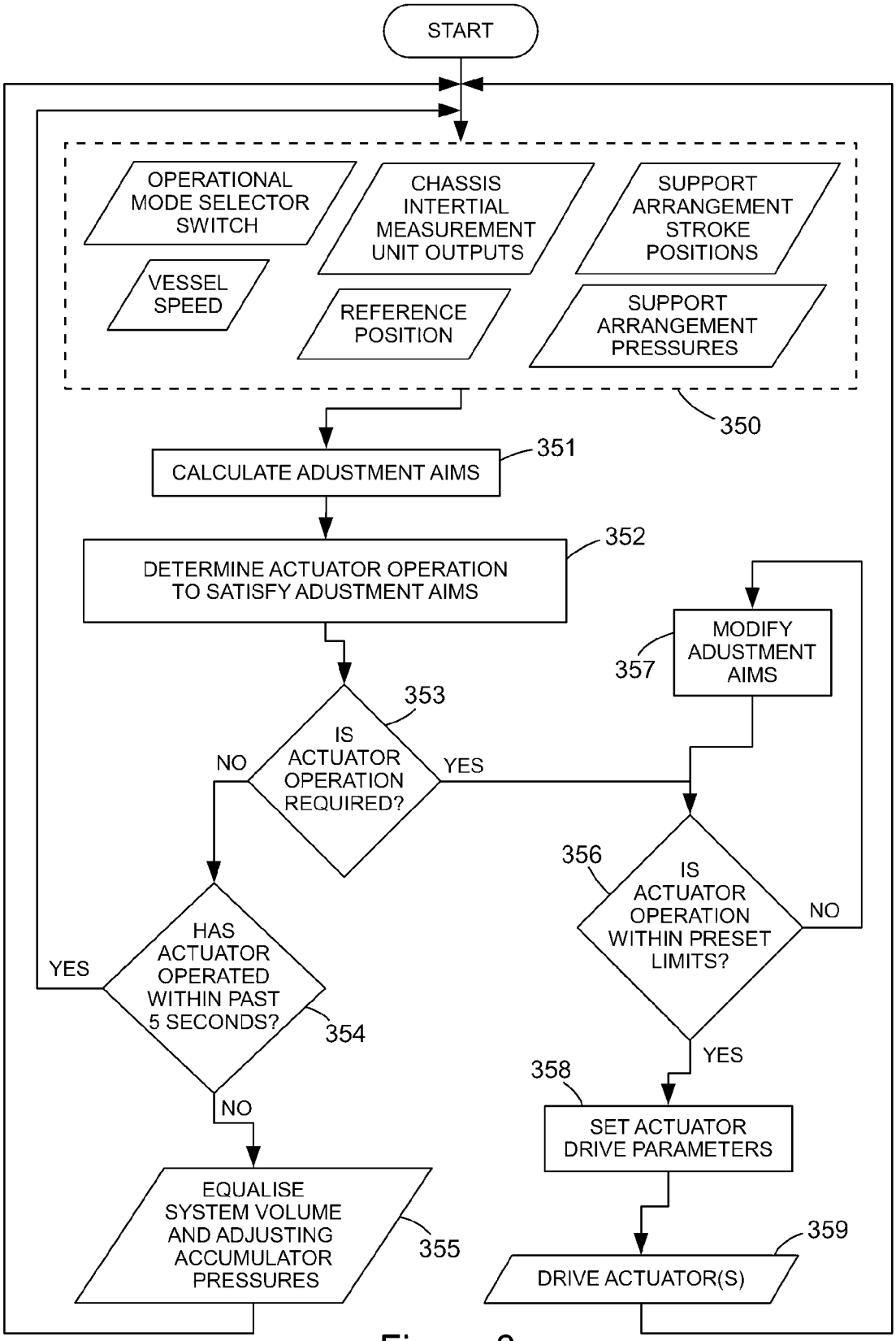
FIG. 8 is a flow chart showing a portion of a possible control method for the present invention.

FIG. 8 shows a flow diagram of a possible control for the actuators of the suspension system. Many sensor inputs 350 are possible and can be acquired, depending on the type of control algorithm used and the desired form of control. For example, when controlling the height of either the entire chassis, or a point on the chassis relative to another fixed or moving object such as a pylon, jetty or mother ship, a reference position input is required indicative of the height delta between at least one point on the vessel and a point on the other fixed or moving object. The form of control such as stabilising the chassis while holding station, docking or while underway can be selected by an operator control or performed at least partially automatically using global positioning data and vessel speed for example. Inputs such as data from chassis or hull inertial measurement units can be used as can the positions and pressures in the support arrangements and the pressure in the adjustment accumulator(s).

Given the inputs 350, adjustment aims can be calculated at 351, which can include modal calculations such as the displacements required in roll pitch and heave to achieve the desired position and if the support arrangements include warp stiffness, such as those in FIGS. 4 and 5, whether adjustments need to be made to reduce torsional loads between the support arrangements. Given conditions such as the existing accelerations of the hulls and chassis, the actual adjustments that need to be made through operation of the actuators (be they for example the individual support arrangement actuators 161, 166, 171, 176 of FIG. 5; the actuators for each edge of the vessel—front back left and right as in FIG. 3; or the modal actuators 37, 42 and 61 of FIGS. 1 and 6) to satisfy the adjustment aims of 351 can be determined at 352.

If at the decision point 353 no actuator operation is required, then it may be appropriate to equalise the pressure between a system volume and its adjusting accumulator by communicating for example the front left adjusting accumulator 163 in FIG. 5 with the front left ram compression chamber 149, the front left resilience accumulator 157 or any other point in the front left compression volume. This can be done by operating a valve that bypasses the adjusting pump 162 as shown in FIG. 7, or by allowing free motion of the pump 162. Referring again to FIG. 8, it can be preferable to ensure that the actuator is not operational and has not been operational for a period of time, such as for example 5 seconds (but can be much shorter), as shown at 354 to prevent unwanted response of the system, before proceeding to equalised the system volume and adjusting accumulator pressures as shown at 355. Similarly the decision point or check at 354 can include verifying that the accelerations on the chassis are within limits, that one or more pressures in the compression volumes are within limits or not varying by more than a pre-set range, or that the stroke positions of at least one or more rams are within limits. Such checks can be used to indicate that the vessel is not undergoing any significant motions or dynamic loads. The pressure is to be equalised while underway, as long as the variation in the compression volume pressures are not varying by such an amount that the pressure in the adjustment accumulator ends up further away from for example an average of the compression volume pressure or outside the limits set, such as within 25% of the static compression volume pressure.

However, if at decision point 353, there is actuator operation required, the actuator operation determined at 352 can be tested at 356 to ensure it is within required limits, for example to limit acceleration or rate of change of acceleration of the controlled actuator adjustment, or to prevent pressure or travel limits being exceeded. If the actuator operation signal(s) are not within such preset limits when tested at 356, the adjustment aims and/or the intended actuator operation can be modified at 357 and tested again at 356. If the actuator operation is within preset limits at 356, the actuator drive parameters can be set at 358 and the actuators driven or otherwise controlled at 359. Then the control can resample some or all of the inputs at 350 and new aims be calculated at 351, and so on.

Where the term "static operating pressure" is used herein, it refers to any condition where the vessel is in a steady state condition with the sum of forces on the vessel being negligible, i.e. when stationary, or when in motion at a constant speed in a straight line (with only small or negligible wave inputs). The pressure input used may be an average pressure (i.e. time averaged).

In all the examples where the actuator drives fluid between an adjustment accumulator and a main system fluid volume, the actuator can be of the displacement type (as shown in most instances) or the force type (as shown with the front pitch actuator 89 in FIG. 2.

Wherever the actuator is of the force type where the adjustment accumulator 93 can also act as a resilience accumulator, as in FIG. 2, then if the adjustment accumulator is in permanent fluid communication with the associated system volume (such as for example the front pitch compression volume in FIG. 2 if valve 96 is omitted) then additional separate resilience accumulators may not be required.

For each of the exemplary hydraulic or hydro-pneumatic suspension systems shown in FIGS. 1 to 6, a separate fluid volume maintenance system can be provided. Such a maintenance system is well known to provide slow speed (low flow) compensation for changes in the typically four main system volumes due for example to temperature changes or a slightly higher flow, but still relatively low speed (i.e. non-dynamic) adjustments in response to payload changes or requested changes in the static or steady state ride height or trim of the vessel for example. Preferably such a maintenance system cooperates with any locks between the system volumes and the adjustment accumulators so that the static pressure in each system fluid volume is balanced with the static pressure in the associated adjustment accumulator.

Any of the suspension arrangements described may include additional independent support means providing an element of support providing roll, pitch and warp stiffness corresponding to the heave stiffness.

Modifications and variations as would be apparent to a skilled addressee are deemed to be within the scope of the present invention.

The invention claimed is:

1. A suspension system for a multi-hulled vessel, the vessel including a chassis and at least one left hull and at least one right hull, the suspension system supporting at least a portion of the chassis relative to the at least one left hull and at least one right hull, the suspension system including a front left support arrangement and a back left support arrangement between the at least one left hull and the chassis and including a front right support arrangement and a back right support arrangement between the at least one right hull and the chassis, each front left, front right, back left, back right support arrangement including at least one respective ram, and the suspension system including a first adjustment accumulator having a fluid chamber and a gas chamber; and a first actuator to transfer or effectively transfer fluid between the fluid chamber of the first adjustment accumulator and at least one compression chamber of a respective at least one ram of a first support arrangement comprising one or more of the front left, front right, back left or back right support arrangements, a static pressure in the gas chamber of the first adjustment accumulator being within 25% of a static operating pressure in the at least one compression chamber of the at least one ram of the first support arrangement.

2. A suspension system according to claim 1 wherein the static pressure in the gas chamber of the first adjustment accumulator is within 15% of the static operating pressure in the at least one compression chamber of the at least one ram of the first support arrangement.

3. A suspension system according to claim 1 wherein the static pressure in the gas chamber of the first adjustment accumulator is within 10% of the static operating pressure in the at least one compression chamber of the at least one ram of the first support arrangement.

4. A suspension system according to claim 1 wherein the static pressure in the gas chamber of the first adjustment accumulator is within 5% of the static operating pressure in the at least one compression chamber of the at least one ram of the first support arrangement.

5. A suspension system according to claim 1 wherein the static pressure in the gas chamber of the first supply accumulator is substantially equal to the static operating pressure in the at least one compression chamber of the at least one ram of the first support arrangement.

6. A suspension system according to claim 1 wherein the first actuator is controllable to adjust an average stroke position of the at least one ram of the first support arrangement and/or to adjust an average pressure in the at least one compression chamber of the at least one ram of the first support arrangement.

7. A suspension system according to claim 1 wherein the first actuator includes a bi-directional pump and a motor to drive the pump.

8. A suspension system according to claim 1 wherein the first actuator includes a bi-directional pump and a motor-generator to drive and be driven by the pump.

9. A suspension system according to claim 1 wherein the first adjustment accumulator includes a moveable wall between the gas chamber and the fluid chamber, the first actuator including the first adjustment accumulator and a first linear motor for at least driving the moveable wall to thereby vary the relative size of the gas and fluid chambers.

10. A suspension system according to claim 9 wherein the first linear motor for at least driving the moveable wall is a motor-generator for driving and being driven by the moveable wall.

11. A suspension system according to claim 9 wherein the first linear motor is a voice coil linear motor.

12. A suspension system according to claim 9 wherein the first linear motor is a lead screw driving the moveable wall.

13. A suspension system according to claim 1 further including second, third and fourth support arrangements, each comprising one or more of the front left, front right, back left or back right support arrangements a second actuator to transfer or effectively transfer fluid between the fluid chamber of a second adjustment accumulator and at least one compression chamber of a respective at least one ram of the second support arrangement, a third actuator to transfer or effectively transfer fluid between the fluid chamber of a third adjustment accumulator and at least one compression chamber of a respective at least one ram of the third support arrangement, and a fourth actuator to transfer or effectively transfer fluid between the fluid chamber of a fourth adjustment accumulator and at least one compression chamber of a respective at least one ram of the fourth support arrangement.

14. A suspension system according to claim 13 wherein a static pressure in a gas chamber of the respective second, third or fourth adjustment accumulator is within 25% of a static operating pressure in the at least one compression chamber of the at least one ram of the respective support arrangement.

15. A suspension system according to claim 13 wherein the first support arrangement comprises the front left support arrangement, the second support arrangement comprises the front right support arrangement, the third support arrangement comprises the back left support arrangement, and the fourth support arrangement comprises the back right support arrangement, and wherein the at least one respective ram of each of the respective front left, front right, back left or back right support arrangements is a respective single ram.

16. A suspension system according to claim 15 wherein the single ram in each of the front left, front right, back left or back right support arrangement is a single-acting ram.

17. A suspension system according to claim 15 wherein the single ram in each of the respective front left, front right, back left or back right support arrangements is a double-acting ram including a respective compression chamber and a respective rebound chamber, the front left compression chamber being connected to the front right rebound chamber, the front right compression chamber being connected to the front left rebound chamber, the back left compression chamber being connected to the back right rebound chamber, the back right compression chamber being connected to the back left rebound chamber.

18. A suspension system according to claim 13 wherein each of the respective front left, front right, back left and back right support arrangements includes two rams comprising a roll ram and a pitch ram, each ram including a respective compression chamber, the first support arrangement being a front pitch support arrangement including the compression chamber of the front left pitch ram and the compression chamber of the front right pitch ram, the second support arrangement being a back pitch support arrangement including the compression chamber of the back left pitch ram and the compression chamber of the back right pitch ram, the third support arrangement being a left roll support arrangement including the compression chamber of the front left roll ram and the compression chamber of the back left roll ram, the fourth support arrangement being a right roll support arrangement including the compression chamber of the front right roll ram and the compression chamber of the back right roll ram.

19. A suspension system according to claim 1 wherein each of the respective front left, front right, back left and back right support arrangements includes two rams comprising a roll ram and a pitch ram, each ram including a respective compression chamber, the first support arrangement being a front pitch support arrangement including the compression chamber of the front left pitch ram and the compression chamber of the front right pitch ram, a second support arrangement being a back pitch support arrangement including the compression chamber of the back left pitch ram and the compression chamber of the back right pitch ram, a third support arrangement being a left roll support arrangement including the compression chamber of the front left roll ram and the compression chamber of the back left roll ram, a fourth support arrangement being a right roll support arrangement including the compression chamber of the front right roll ram and the compression chamber of the back right roll ram.

20. A suspension system according to claim 19 wherein each of the respective front left, front right, back left and back right roll rams is a double acting ram including a respective rebound chamber, the third support arrangement further including the rebound chamber of the front right roll ram and the rebound chamber of the back right roll ram, the fourth support arrangement further including the rebound chamber of the front left roll ram and the rebound chamber of the back left roll ram.

21. A suspension system according to claim 19 wherein each of the respective front left, front right, back left and back right pitch rams is a double acting ram including a respective rebound chamber, the first support arrangement further including the rebound chamber of the back left pitch ram and the rebound chamber of the back right pitch ram, the second support arrangement further including the rebound chamber of the front left pitch ram and the rebound chamber of the front right pitch ram.

22. A suspension system according to claim 19 further including a second actuator to transfer or effectively transfer fluid between the fluid chamber of a second adjustment accumulator and at least one compression chamber of a respective at least one ram of the second support arrangement, a third actuator to transfer or effectively transfer fluid between the fluid chamber of a third adjustment accumulator and at least one compression chamber of a respective at least one ram of the third support arrangement, and a fourth actuator to transfer or effectively transfer fluid between the fluid chamber of a fourth adjustment accumulator and at least one compression chamber of a respective at least one ram of the fourth support arrangement.

23. A suspension system according to claim 19 further including a second actuator to transfer or effectively transfer fluid between the fluid chamber of a second adjustment accumulator and at least one compression chamber of a respective at least one ram of the second support arrangement, a third actuator to transfer or effectively transfer fluid between the at least one compression chamber of a respective at least one ram of the third support arrangement and at least one compression chamber of a respective at least one ram of the fourth support arrangement.

24. A suspension system according to claim 1 wherein each of the respective front left, front right, back left and back right support arrangements includes two rams comprising a roll ram and a pitch ram, each ram including a respective compression chamber, the suspension system further including:

a front pitch compression volume including the compression chamber of the front left pitch ram and the compression chamber of the front right pitch ram, a back pitch compression volume including the compression chamber of the back left pitch ram and the compression chamber of the back right pitch ram, a left roll compression volume including the compression chamber of the front left roll ram and the compression chamber of the back left roll ram, and a right roll compression volume including the compression chamber of the front right roll ram and the compression chamber of the back right roll ram.

25. A suspension system according to claim 24 wherein each of the respective front left, front right, back left and back right roll rams is a double acting ram including a respective rebound chamber, the left roll compression volume further including the rebound chamber of the front right roll ram and the rebound chamber of the back right roll ram, the right roll compression volume further including the rebound chamber of the front left roll ram and the rebound chamber of the back left roll ram.

26. A suspension system according to claim 24 wherein each of the respective front left, front right, back left and back right pitch rams is a double acting ram including a respective rebound chamber, the front pitch compression volume further including the rebound chamber of the back left pitch ram and the rebound chamber of the back right pitch ram, the back pitch compression volume further including the rebound chamber of the front left pitch ram and the rebound chamber of the front right pitch ram.

27. A suspension system according to claim 24 further including a heave device forming the first support arrangement, the heave device comprising a heave piston assembly having four system volume pressure areas and a heave pressure area, the system volume pressure areas of the heave piston assembly being slidable inside respective system volume bores and being fixed relative to the heave pressure area of the heave piston assembly which is slidable inside a heave bore, the four system volume bores each being respectively connected to a respective one of the front pitch, back pitch, left roll and right roll compression volumes, the heave bore being connected to the first adjustment accumulator such that when the first actuator transfers fluid between the first adjustment accumulator and the heave bore, the heave piston assembly slides inside the heave and system volume bores, thereby effectively transferring fluid between the first adjustment accumulator the compression chambers of the pitch and roll rams of each of the front left, front right, back left and back right support arrangements.

28. A suspension system according to claim 24 further including a second actuator to transfer or effectively transfer fluid between the front pitch compression volume and the back pitch compression volume, and a third actuator to transfer or effectively transfer fluid between the left roll compression volume and the right roll compression volume.

29. A suspension system according to claim 1 wherein each of the respective front left, front right, back left and back right support arrangements comprises a single respective single-acting ram, each ram including a respective compression chamber, the suspension system further including:

a warp and heave device comprising: a first diagonal device connected to the front left and back right rams; and a second diagonal device connected to the front right and back left rams, each diagonal device including a first cylinder axially aligned with a second cylinder, the first cylinder including a piston connected to a rod extending into the second cylinder, forming first, second and third chambers, the rod being accommodated in the first and second chambers being a front system chamber and a back system chamber, the first and second chambers varying in volume in a common direction with motion of the piston and rod and varying in an opposite direction to the third chamber being a diagonal chamber, the front system chamber of the first diagonal device being connected to the compression chamber of the front left ram, the back system chamber of the first diagonal device being connected to the compression chamber of the back right ram, the front system chamber of the second diagonal device being connected to the compression chamber of the front right ram, the back system chamber of the second diagonal device being connected to the compression chamber of the back left ram, the diagonal chamber of the first diagonal device being connected to the diagonal chamber of the second diagonal device forming a heave volume further including a heave resilience accumulator, the first adjustment accumulator being connected to the heave volume such that when the first actuator transfers fluid between the first adjustment accumulator and the heave volume, the piston and rod in each diagonal device is displaced, effectively transferring fluid to the compression chambers of the front left, front right, back left and back right rams in the respective support arrangements.

30. A suspension system according to claim 29 further including a pitch device comprising three axially aligned cylinders, three pistons connected together by two rods each piston being disposed one to each cylinder to divide each cylinder and form a front pitch chamber, a front left chamber, a front right chamber, a back left chamber, a back right chamber and a back pitch chamber and a roll device comprising three axially aligned cylinders, three pistons connected together by two rods forming a left roll chamber, a front left chamber, a front right chamber, a back left chamber, a back right chamber and a right roll chamber, the respective front left, front right back left and back right chambers of the pitch device and of the roll device are connected to the respective compression chambers of the respective rams.

31. A suspension system according to claim 30 further including a pitch actuator to transfer or effectively transfer fluid between the front pitch chamber and the back pitch chamber, and a roll actuator to transfer or effectively transfer fluid between the left roll chamber and the right roll chamber.

32. A method of controlling a suspension system for a multi-hulled vessel having a chassis and at least two hulls, the vessel further including front left, front right, back left and back right support arrangements between the chassis and the at least two hulls, each support arrangement including at least one ram having at least one compression chamber the method including the steps of:

determining a control mode;

sensing any one or more of a control switch position, at least one displacement, at least one velocity, at least one acceleration and at least one force or pressure in the suspension system;

controlling at least a first actuator configured to transfer or effectively transfer fluid from a first adjustment accumulator to the at least one compression chamber of the at least one ram of at least one of the support arrangements to adjust a heave, roll and/or pitch of the chassis, a static pressure in the first adjustment accumulator being within 25% of a static pressure in the at least one compression chamber of the at least one ram of at least one of the support arrangements.

33. A method of controlling a suspension system according to claim 32 further including the step of controlling the static pressure in the first adjustment accumulator.

34. A method of controlling a suspension system according to claim 33 further including, before controlling the static pressure in the first adjustment accumulator any one or more of the steps of:

checking that the first actuator is not operating;

checking that the vessel is in a substantially static or steady state condition;

measuring a static, steady state or average pressure in the first adjustment accumulator and measuring a static, steady state or average pressure in the at least one compression chamber of the at least one ram of at least one of the support arrangements.

35. A method of controlling a suspension system according to claim 33 wherein a valve in a bypass around the first actuator is selectively openable to allow communication between the first adjustment accumulator and the at least one compression chamber of the at least one ram of at least one of the support arrangements, and the step of controlling the static pressure in the first adjustment accumulator includes opening the valve in the bypass around the first actuator.

36. A suspension system according to claim 10 wherein the first linear motor is a voice coil linear motor.

* * * * *